US006098815A

United States Patent [19]

Nesser

[11] Patent Number: 6,098,815

[45] Date of Patent: Aug. 8, 2000

[54] SHOE RACK SYSTEM

[76] Inventor: Jacalyn C. Nesser, 3955 College Rd., Farmington, Mo. 63640

[21] Appl. No.: 09/282,509

[22] Filed: Mar. 31, 1999

[51] Int. Cl.[7] ..... A47F 5/00

[52] U.S. Cl. ..... 211/34; 211/38; 211/118; 211/162

[58] Field of Search ..... 211/34, 37, 38, 211/162, 94.02, 113, 119, 201, 118; 312/246

[56] References Cited

U.S. PATENT DOCUMENTS

| | | | |
|---|---|---|---|
| 1,198,431 | 9/1916 | Forsyth | 211/38 X |
| 1,423,417 | 7/1922 | Gorman | 211/38 |
| 1,874,056 | 8/1932 | Matallana | 211/38 |
| 2,901,117 | 8/1959 | Plocki et al. | 211/38 |
| 4,008,807 | 2/1977 | Phillips . | |
| 4,463,853 | 8/1984 | Licavi et al. | 211/37 |
| 4,585,127 | 4/1986 | Benedickt . | |
| 5,076,422 | 12/1991 | Hakeem . | |
| 5,680,942 | 10/1997 | McAllister et al. | 211/162 |
| 5,785,185 | 7/1998 | Klebba | 211/37 |
| 5,894,940 | 4/1999 | Gusdorf et al. | 211/94.02 X |

*Primary Examiner*—Robert W. Gibson, Jr.
*Attorney, Agent, or Firm*—Polster, Lieder, Woodruff & Lucchesi, L.C.

[57] ABSTRACT

A shoe rack has two frame members spaced laterally to provide an open space between them sufficient to receive shoes. Each of the frame elements has crossbars spaced vertically from one another and carrying a plurality of shoe mounts spaced along the bars and arranged to hold shoes with their soles and heels facing inwardly into the open space between the frame members. A spacer extends between the two frame members. The spacer has a channel running along each edge, that carries on each side, a roller. Rails are mounted to a fixed element of a closet and the rollers on each side of the spacer are mounted to roll in the rails. The rails have rollers that run on a track carried by the spacer. The two frame members are connected by links pivotally mounted at two ends, so that the frame members, when not attached to the spacer, can be folded substantially flat for shipping or storage.

6 Claims, 4 Drawing Sheets

SHOE RACK SYSTEM

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

Various systems for organizing shoes in a closet or the like have been posed, among them those shown in Hakeem U. S. Pat. Nos. 5,076,442, Benedict, 4,585,127, and Phillips, 4,008,807, for example. The shoe rack system of this invention is of the general type shown in U.S. Pat. No. 5,076,442, a sliding rack mounted to a fixed element of a closet.

One of the objects of this invention is to provide a shoe rack system wherein pairs of shoes are oriented so that their soles and heels face one another in a space between them.

Another object is to provide a rack with two, laterally spaced, frames that can be folded substantially flat for shipping or storage.

Other objects will become apparent to those skilled in the art and in light of the following description and accompanying drawing.

BRIEF SUMMARY OF THE INVENTION

In accordance with this invention, generally stated, a shoe rack is provided that comprises two frame members, spaced laterally to provide an open space between them sufficient to receive shoes, each of the frame members having crossbars spaced vertically from one another, the crossbars having a plurality of shoe mounts spaced along them, and arranged to hold shoes with their soles and heels facing inwardly in said open space. The frame members in the embodiment shown, comprise vertical post members joined at their upper end by a header bar, the crossbars extending between the posts, a spacer to which the header bars are selectively mounted when the rack is fully assembled, and demounted for shipping or storage. In the preferred embodiment, the spacer has running along two parallel long edges, a channel on each side, the channel having a foot mounted on the spacer, a riser, and an outboardly directed overhang along the top edge of the riser, and a roller mounted on the riser at or near one end of the channel. Rail members with a track along a long edge, have a roller wheel mounted at or near an end remote from the roller of the channel of the spacer. The wheel of the rail engages the overhang of the spacer channel, and the wheel of the spacer channel engages a track of the rail. Means are provided for mounting the rails to a fixed element of a closet. The term "closet" is used herein to mean any space in which the rack can be mounted, including the standard closet with a shelf, to the underside of which the rails can be attached, wardrobes, or even tables or desks, beneath which the rack can be mounted.

The frame members are preferably connected by links pivotally mounted to side surfaces of the vertical posts in such a way as to permit the frame members to be folded substantially flat for shipped or storage.

DETAILED DESCRIPTION OF THE PREFERRED EMBODIMENT

Figure 1:
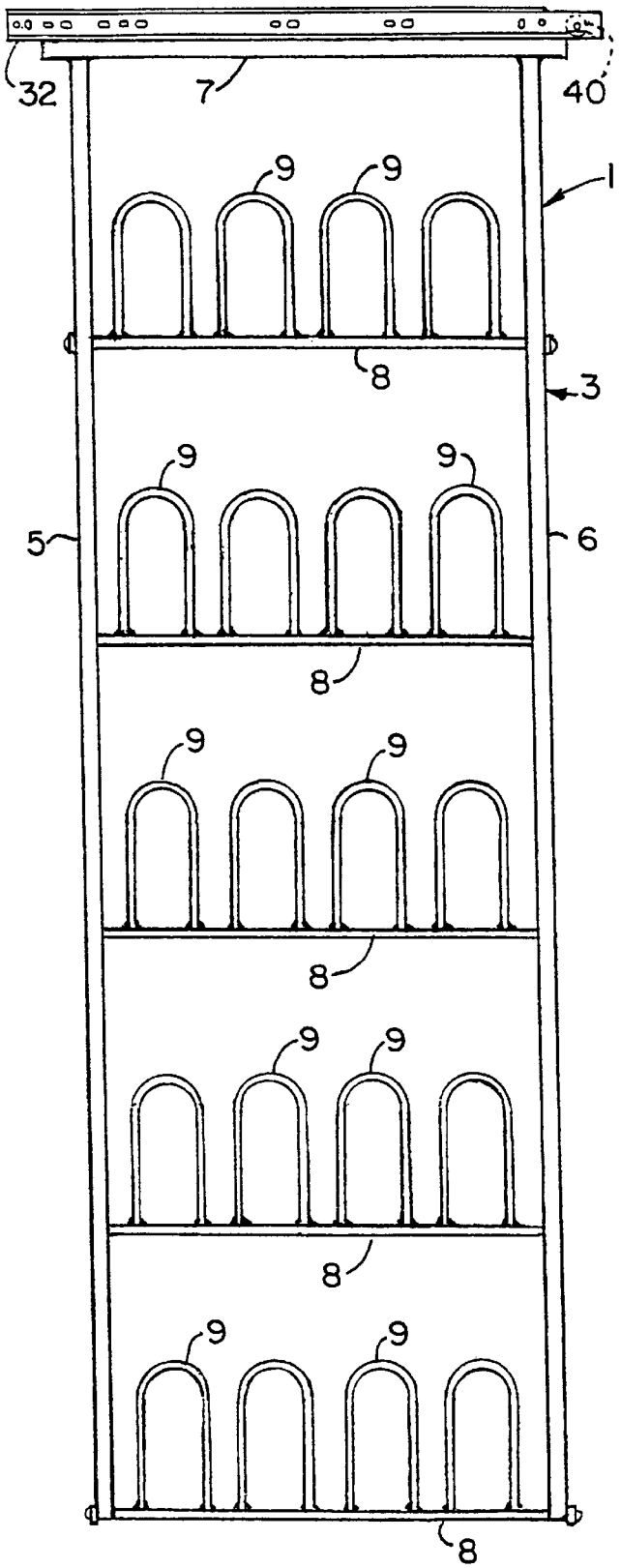
FIG. 1 is a view in side elevation of one embodiment of rack of this invention.
Figure 2:
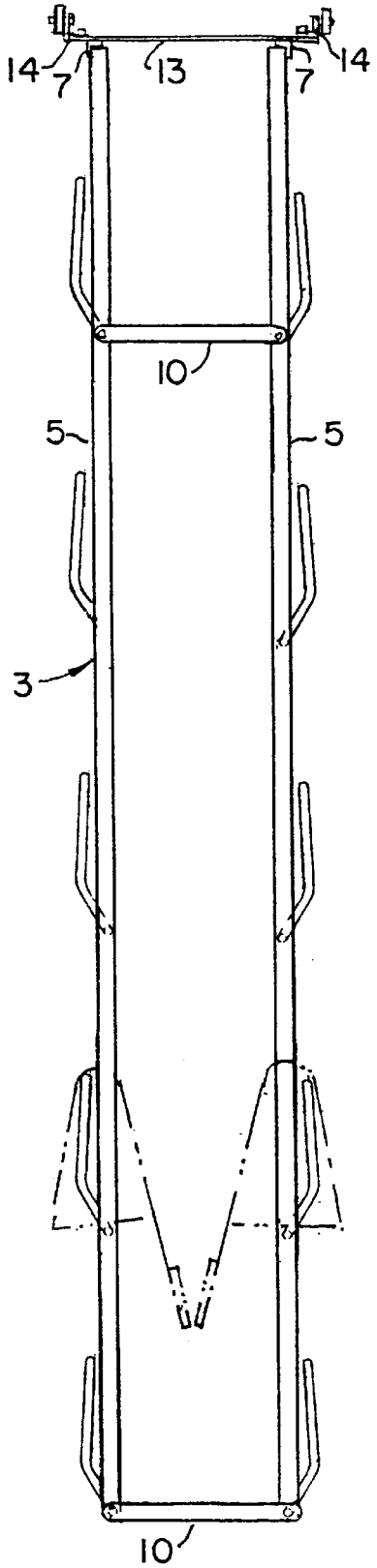
FIG. 2 is a view in rear elevation of the rack shown in FIG. 1.
Figure 3:
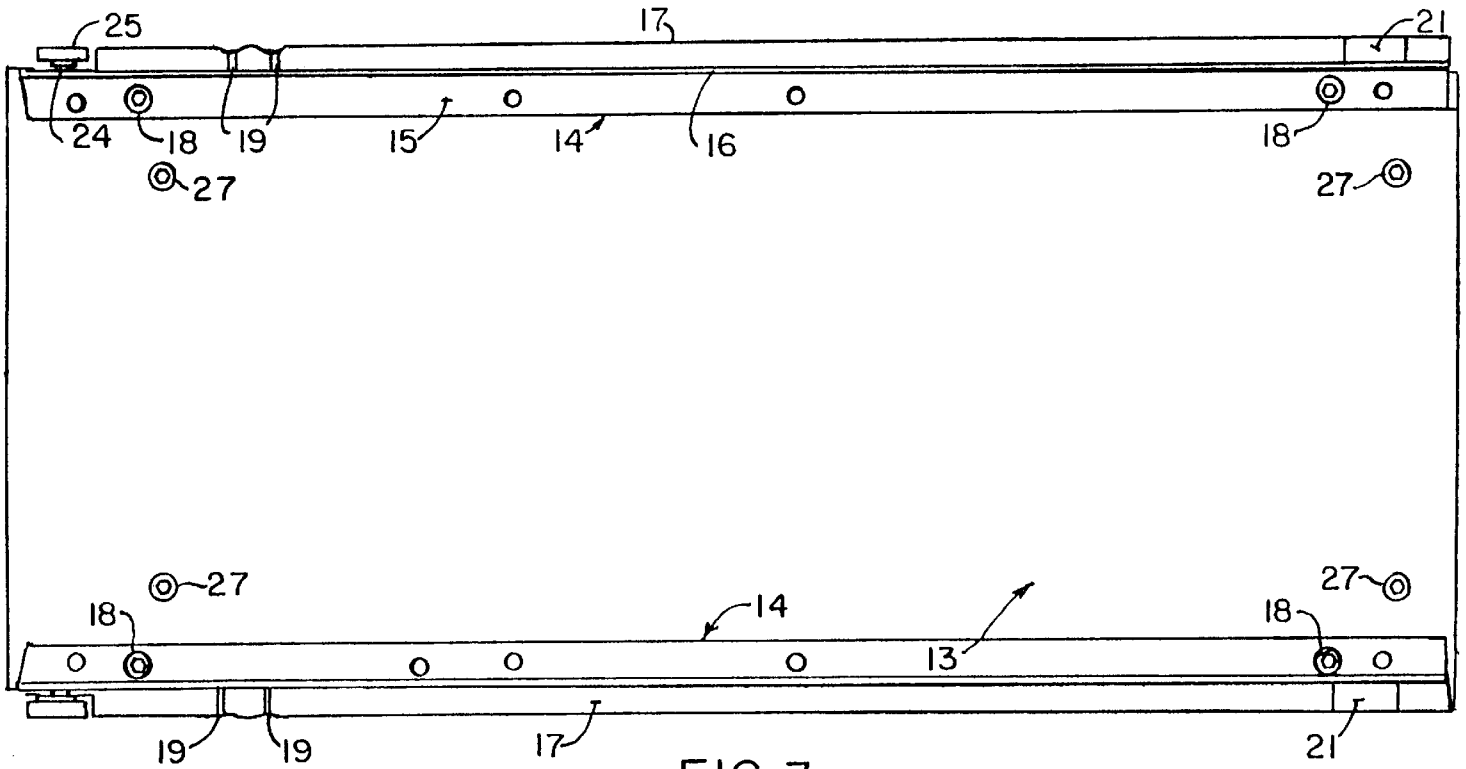
FIG. 3 is a top plan view of the rack, showing a spacer and channels secured to the spacer.
Figure 4:
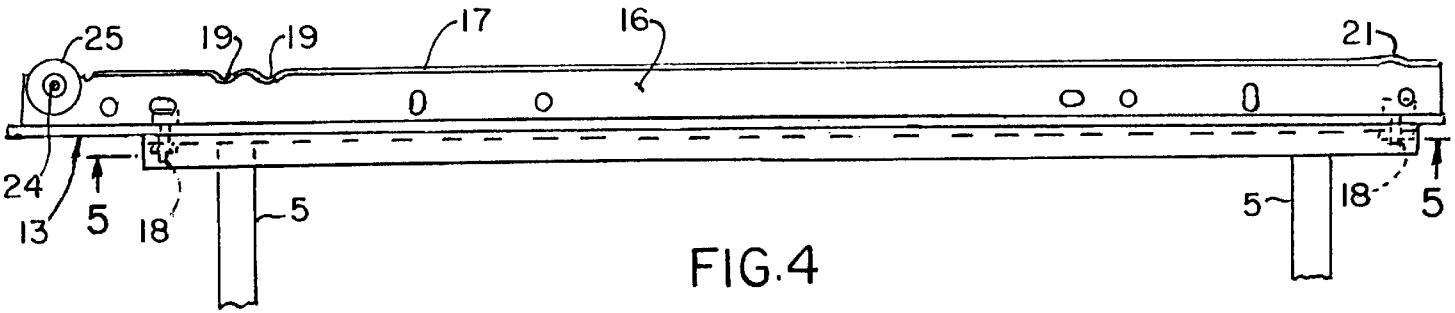
FIG. 4 is a view in side elevation of the device shown in FIG. 3, with posts shown fragmentarily.
Figure 5:
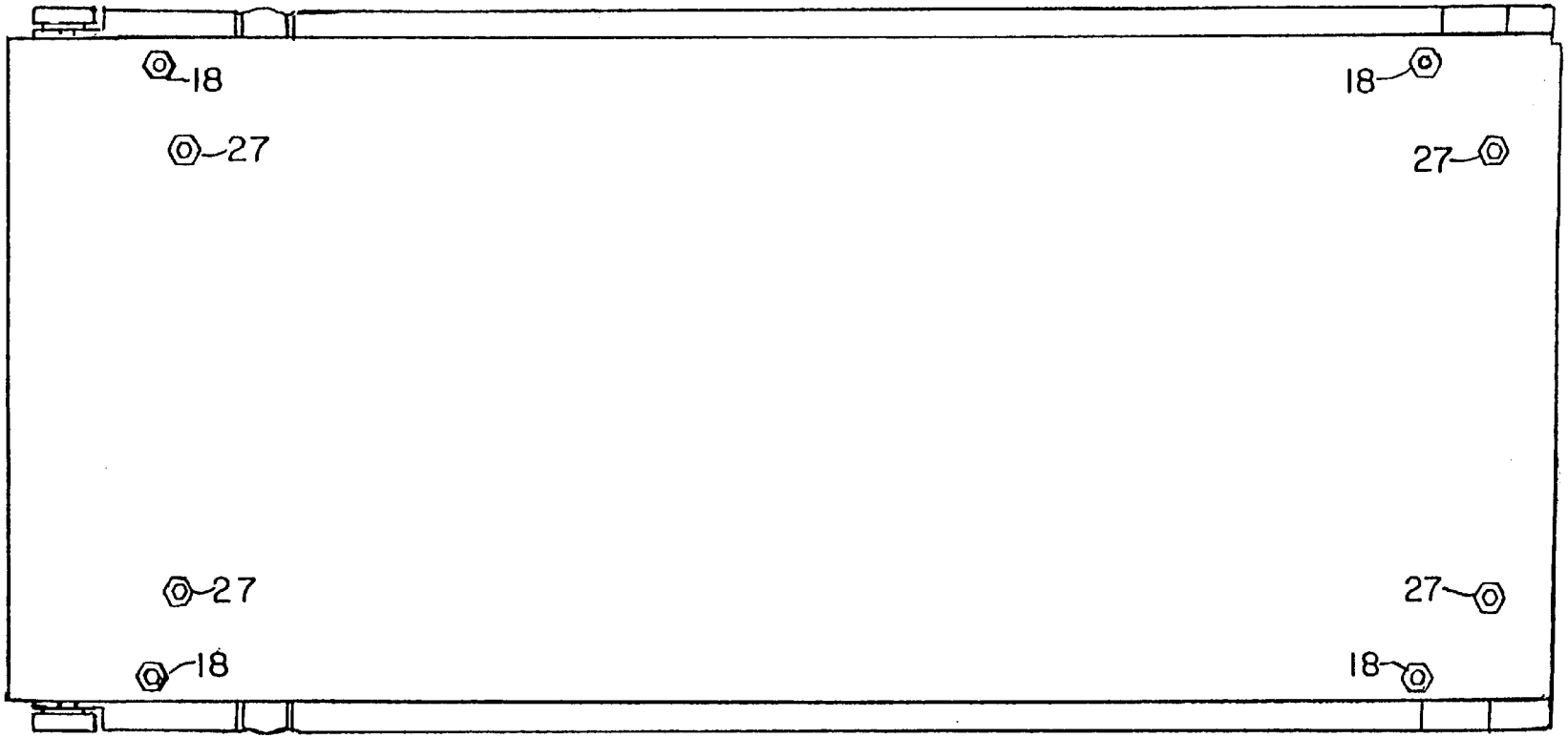
FIG. 5 is a bottom plan view of the spacer and channels shown in FIGS. 3 and 4.

Referring now to the drawing for one illustrative embodiment of this invention, reference numeral 1 indicates a completed rack, which in FIG. 1 is shown as mounted on a rail 32, one of a pair of rails 30 and 32. The rack is made up of two frame members 3. The frame members 3 are made up of posts 5 and 6, in the embodiment shown, hollow rods square in cross section, joined at their upper ends by a header bar 7, which, in this embodiment, is in the form of an angle to one leg of which the posts are welded, and the other leg of which extends over the top of the posts, as shown in FIG. 2. The frame members 3 are connected below the header bar 7 by links 10 pivotally mounted at their ends to a side surface of the posts 5, as shown particularly in FIG. 2. Shoe support bars 8 are welded at their ends to facing surfaces of the posts 5 and 6, as shown in FIG. 1. The support bars 8 carry U-shaped shoe carriers 9, welded at their open ends to the bars 8, and bent at their lower ends, as shown in FIG. 2, to accommodate shoes oriented with their soles and heels within the space between the frames 3, as shown somewhat schematically in FIG. 2. To accommodate high heels, the carriers 9 of one frame can be offset from the carriers 9 of the other frame, either horizontally or vertically, or both.

The spacer 13, in the form of a rectangular sheet of plastic, masonite, plywood or the like, is bolted to the frames by means of bolts 27, passing through holes in the overlying leg of the header bar 7, and in the spacer. Channels 14 are mounted on the spacer along two long edges of the spacer. The channels 14 have a foot 15, a riser 16, and an overhang 17 integral with the riser 16. Indentations 19 in the overhang 17 serve as stops, and a bulge 21 facilitates assembly of the device to rails 30 and 32. The channels 14 are mounted to the spacer by means of bolts 18 extending through holes in the foot 15 and corresponding holes in the spacer. At one end of the channel 14, the overhang 17 is cut away to accommodate a roller 25, which is mounted on a stub axle 24 secured to the riser 16.

When the frames are detached from the spacer by removing the bolts 27, the two frame members can be folded substantially flat against one another by virtue of the pivoting of the links 10.

Figures 6, 7, 8:
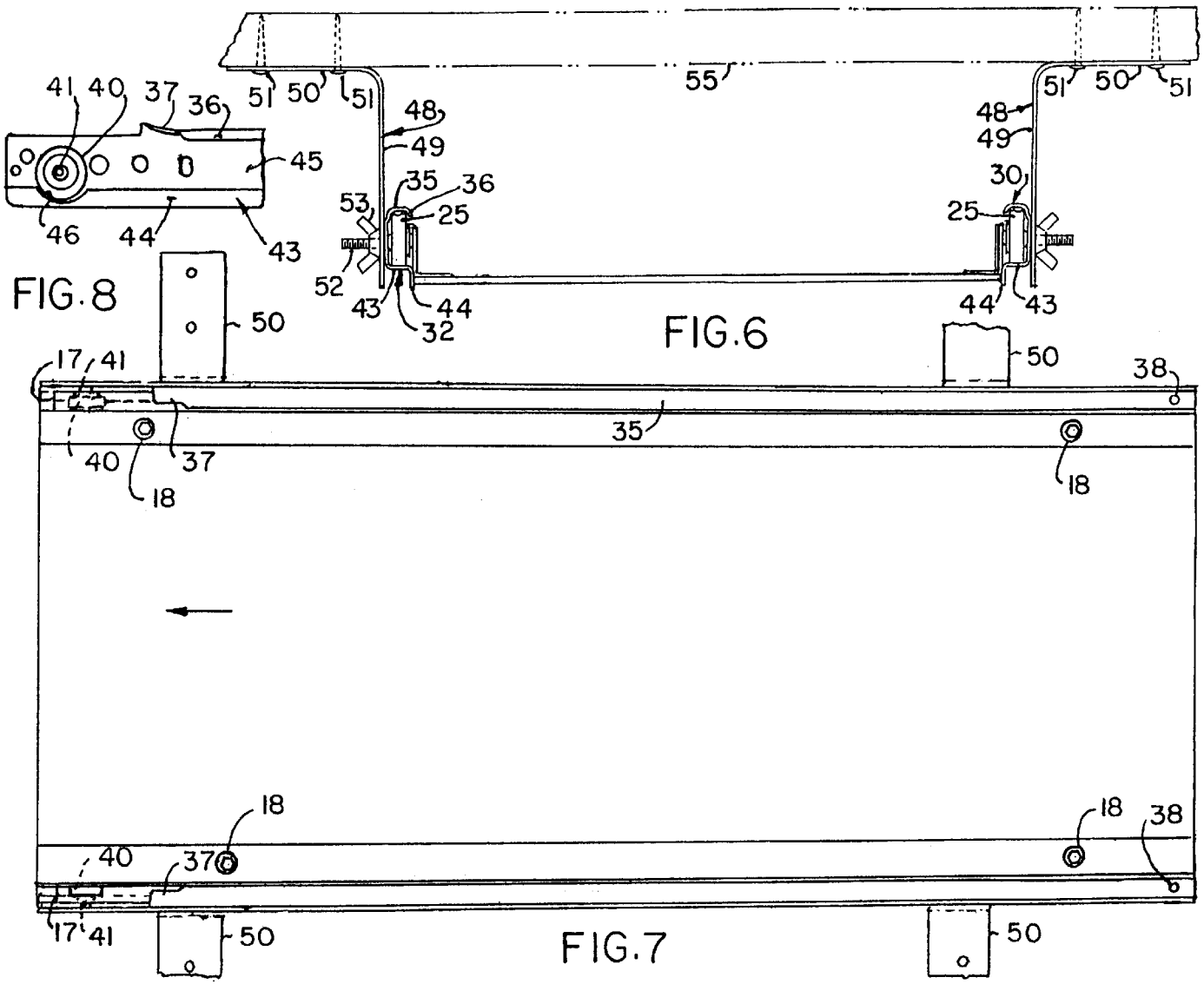
FIG. 6 is a view in front elevation of the spacer mounted in rails fastened to the underside of a support.
FIG. 7 is a top plan view, without the fixed element, and with three of the mounting brackets shown fragmentarily.
FIG. 8 is a fragmentary side view of one end of a rail.

The assembled frame is mounted on the rails 30 and 32, which, in the embodiment illustrated, are mounted on the underside of a support 55, as, for example, a closet shelf, by means of hangers 48, which in this embodiment are shown as angles with a drop leg 49 and a fastener leg 50, the latter having holes in it to receive screws 51, which are screwed into the support 55. The drop leg 49 has vertically spaced holes in it to receive countersunk head bolts, the head engaging a countersunk area around holes in the rails 30 and 32, as shown in FIG. 6. The bolts 52 have wing nuts 53 on them, to permit easy adjustment of the height of the racks from the floor.

The rails 30 and 32 are mirror images of one another. Each has a track section 35 along its upper edge, the track 35 having an inboardly turned lip 36, and at one end a flare 37 ending short of the end of the rail, as shown particularly in FIG. 8. Along its lower edge, the rail has a lower flange 43, with a depending skirt 44 along its inboard edge. The lower flange 43 and skirt 44 are cut away as shown at 46, to accommodate a roller 40 mounted on an stub shaft 41 carried by a web extending between the track 35 and the flange 43, beyond the flair 37.

Figure 9:
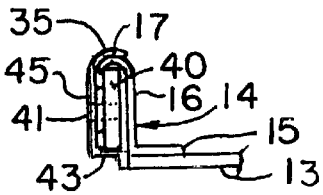
FIG. 9 is a fragmentary view in end elevation of the front end of the mounted rack.

When assembled, as shown in FIG. 6, the roller 40 engages the undersurface of overhang 17 of the channel 14, as shown in FIG. 9, and the roller 25 engages the flange 43, as shown in FIG. 6. As the rack is moved to open position, in the direction shown by an arrow in FIG. 7, and the center of gravity of the rack moves beyond the roller 40, the roller 25 can engage the track 35. The rail rollers 40 are positioned at the open end of the closet mounted frame. The rollers 25 can be introduced to the rails 30 and 32 at the flare 37, and the overhang 17 moved under the track 35 to mount the frame between the rails. The rack can then be moved smoothly between extended and retracted positions.

Numerous variations in the construction of the rack of this invention within the scope of the appended claims will occur to those skilled in the art in view of the foregoing disclosure. Merely by way of example, the posts can be made of solid rods, or of shapes different from square in cross-section. The shoe supports can be shaped differently or made differently, as long as they provide support for shoes extending inboardly of the frames. The shoe supports can be made integral with the support bars. The support bars themselves can take different forms, such as an angle or channel. If made in the form of a channel or angle with a tab extending over a flat side of the posts and welded thereto the bars will add rigidity to the frame. The header bar can be made with different configurations, or, if provision is made for receiving a sheet metal screw, or a bolt, as by capping the posts with a closure drilled to receive the screw or drilled and tapped to receive a bolt, the header bar can be eliminated, the posts being secured to the spacer directly. The description "posts mounted to said spacer" as used herein embraces either the form in which a header bar is used or in which the posts are mounted directly. Although the described construction of the rails and spacer channels provides an effective and relatively inexpensive means for rollingly suspending the rack, other rolling suspensions can be used. In certain modular closets, the rails can be attached directly to a wall by means of screws or the like, rather than being suspended from an overhead shelf on a bracket. A bottom spacer can be connected to the frames, although it has not been found necessary. These variations are merely illustrative.

I claim:

1. A shoe rack comprising two frame members, said frame members being spaced laterally to provide an open space between them sufficient to receive shoes, each of said frame members having cross bars spaced vertically from one another, said cross bars having a plurality of shoe mounts spaced along said bars and arranged to hold shoes with their soles and heels facing inboardly into said open space, said frame members comprising vertical posts between which said cross bars extend, a header bar secured to upper ends of said posts, a spacer to which said header bar is mounted, rollers mounted on said spacer, rails having rollers to engage a track on said spacer, and mounting means for mounting said rails to a fixed element of a closet.

2. A shoe rack comprising two frame members, said frame members being spaced laterally to provide an open space between them, each of said frame members having cross bars spaced vertically from one another, said cross bars having a plurality of shoe mounts spaced along said bars and arranged to hold shoes, said frame members comprising vertical posts between which said cross bars extend, a header bar secured to upper ends of said posts, a spacer to which said header bar is mounted, rollers mounted on said spacer, rails having rollers to engage a track on said spacer, and mounting means for mounting said rails to a fixed element of a closet said frame members being joined by links ends of which are pivotally mounted to said posts, whereby the frame members can be folded generally flat for shipment or storage.

3. A shoe rack comprising two frame members, said frame members being spaced laterally to provide an open space between them sufficient to receive shoes, each of said frame members having cross bars spaced vertically from one another, said cross bars having a plurality of shoe mounts spaced along said bars and arranged to hold shoes with their soles and heels facing inboardly into said open space, wherein said frame members comprise vertical posts between which said cross bars extend, and a spacer, said posts being mounted to said spacer at their upper ends and wherein the frame members are joined by links, ends of which are pivotally mounted to said posts, whereby the frame members can be folded generally flat for shipment or storage when said header bar is demounted from said spacer.

4. A sliding shoe rack for mounting in a closet, comprising two frame members, spaced laterally, each of said frame members being made up of spaced elongated posts connected at upper ends by a header bar and carrying shoe support members in the form of cross bars between them, shoe mounting members secured to said cross bars and adapted to have shoes mounted on them oriented to position soles and heels of said shoes in the space between the said frame members, a spacer extending between said frames at an upper end thereof, said header bars being mounted to said spacer, said spacer having channels along two long edges of said spacer, each of said channels having a riser and a track and a roller mounted on said riser near one end of said channel, mounting rails with an overhang extending over said track, a flange spaced from said track, a web extending between said track and said flange and a roller revolvably mounted on the web at an end of said spacer remote from said rail roller, and means for mounting said rails to a fixed element of a closet.

5. The rack of claim 4 wherein the frame members are connected by links pivotally mounted on opposite of said posts, whereby when the frame members are detached from the spacer, the frame members can be folded generally flat for shipping or storage.

6. A shoe rack comprising two frame members, said frame members being spaced laterally to provide an open space between them, each of said frame members having cross bars spaced vertically from one another, said cross bars having a plurality of shoe mounts spaced along said bars and arranged to hold shoes, said frame members comprising vertical posts between which said cross bars extend, a header bar secured to upper ends of said posts, a spacer to which said header bar is mounted, rollers mounted on said spacer, rails having rollers to engage a track on said spacer, and mounting means for mounting said rails to a fixed element of a closet.

* * * * *